US006591889B2

(12) United States Patent
Bettio et al.

(10) Patent No.: US 6,591,889 B2
(45) Date of Patent: Jul. 15, 2003

(54) FLY SCREEN WITH A QUICK-RELEASE MECHANISM FOR HOOKING AND UNHOOKING THE HANDLE

(75) Inventors: Denis Bettio, Marcon (IT); Loris Bettio, Marcon (IT)

(73) Assignee: Bettio Group Srl, Marcon (IT)

( * ) Notice: Subject to any disclaimer, the term of this patent is extended or adjusted under 35 U.S.C. 154(b) by 0 days.

(21) Appl. No.: 10/112,842

(22) Filed: Mar. 29, 2002

(65) Prior Publication Data

US 2002/0139492 A1 Oct. 3, 2002

(30) Foreign Application Priority Data

Mar. 30, 2001 (IT) ..... 2001A000

(51) Int. Cl.[7] ..... E06B 9/54
(52) U.S. Cl. ..... 160/290.1

(58) Field of Search ..... 160/290.1, 275, 160/276, 280, 281, 288, 289

(56) References Cited

U.S. PATENT DOCUMENTS 5,090,468 A * 2/1992 Tedeschi ..... 160/290.1
6,296,040 B1 * 10/2001 Schaap ..... 160/290.1

* cited by examiner

*Primary Examiner*—David Purol
(74) *Attorney, Agent, or Firm*—Harrison & Egbert

(57) ABSTRACT

A fly screen apparatus having a screen with a handle at an end thereof. The handle has opposite ends received respectively within a pair of runners. The runner has a guide and positioning track formed on an inside surface of the runner. An intermediate rest element is formed in an intermediate position on the side of the runner. The handle has a guide piece supporting a tip which is longitudinally mobile. The tip follows the guide and positioning track so as to be located in various positions within the runners.

5 Claims, 1 Drawing Sheet

FLY SCREEN WITH A QUICK-RELEASE MECHANISM FOR HOOKING AND UNHOOKING THE HANDLE

FIELD OF THE INVENTION

The aim of this invention is a fly screen with a quick-release mechanism for hooking and unhooking the handle, used particularly for fly screens with a chain operated movement.

The invention has particular, but not necessarily exclusive, application in the sector involved in accessories for fixtures and fittings.

BACKGROUND OF THE INVENTION

The fly screens which are currently available may be divided into two main categories. The first type is made-to-measure, manufactured according to the dimensions required for a given client, delivered to the client and installed by a specialized installation technician. The other type is sold in kit form, and is the type which is most widely available on the market.

The latter type of fly screen, characterized by the fact that it is reasonably efficient and economic, is the main target area at which this invention is aimed. Large quantities of components have to be fabricated and transported by the manufacturing companies, especially when dealing with overseas markets. The "do-it-yourself" concept is widely used and offers a product that satisfies most normal requirements, although it is not up to the standards of the made-to-measure type.

Both of the examples mentioned have certain components in common, especially the casing, which is generally made from extruded aluminum bar. It is used to house the co-axial rewind mechanism for the fly screen, roller blind or sun blind, which in the manual version has a corresponding loaded return spring. The ends of the casing are sealed by special plates or headers, which are supplied in two different versions, that is, a fixed type or together with counter-plates or caps that can be regulated.

There are obviously a number of variations, although they are very similar to the systems described, and are just as common in fly screens as in roller blinds and sun blinds. One of these variations, for example, is the lower quality fly screens which do not have the aforementioned return spring inside the mechanism. They differ from the first type in that both the unwinding and rewinding operations of the fly screen are carried out manually. In this case, there is a closed-loop chain that hooks around a cog or pulley fixed on one end of the relative rewind roll, which is housed inside a casing, in order to unwind or rewind the screen in a controlled manner.

These solutions foresee the fabrication of assemblies, for example fly screens, which are basically made up as follows:

- a casing which is closed at its ends by corresponding headers;
- a rewind roll housed inside the casing, supported at each end by a pair of header plates which are fixed to the ends of the casing;
- a helicoidal torsion spring positioned co-axially, and which works in conjunction with the rewind roll;
- a rod positioned co-axially to the helicoidal spring;
- a piece of material or cloth, either net type or for shading purposes, with one end joined to the rewind roll and the other end joined to a handle; and
- two runners, in which the two ends of the handle and the edges of the material or cloth slide.

Especially with the type that has the rewind roll controlled by the closed-loop chain mechanism, certain drawbacks have been encountered. They are due to the fact that the material or cloth is only held tight by the handle, which usually has a counterweight. As a result, this type of assembly has no means which acts upon the handle to counteract pressure exerted on the surface of the material or cloth which may cause it to lift up. In fact, if the material or cloth is subjected to pressure on the surface, due to winds or a part of the body accidentally pushing against it, it is deformed according to the amount of pressure exerted, with the handle being lifted proportionally to the deformation of the material or cloth. This deformation, which is usually random, produces a phenomenon which is known as "sail effect".

This so-called "sail effect" causes certain drawbacks. Firstly, the efficiency of the material or cloth may be compromised because, especially with the cheaper fly screens, the lateral edges tend to come out of the runners to leave openings through which insects may enter or, in the case of sun blinds, light.

Secondly, because of the continuous effect of the wind which blows in various directions, the fly screen may be noisy, an effect that is increased by the sudden rubbing of the components due to the up and down vertical movement and lateral play of the handle inside its relative runners.

In order to overcome these and other drawbacks, and at a considerable cost, some consumers choose fly screens with two battens which slide horizontally rather than vertically. In this case, the material or cloth is unwound by pulling the handle in one direction, and fixing it in position when it reaches its limit with vertically mobile fasteners, the ends of which go inside corresponding seats, usually positioned on the lower runner. Since this type of fly screen has two battens, both purchase price and installation costs are obviously higher. This is because two casings are usually required, each one positioned vertically along the two corresponding sides of the space to be fitted out. On the other hand, a large part of the extra cost for each fitting depends on each individual supplier and on the type of assembly used and which, operating in a different direction compared with traditional methods, requires more complicated manufacturing operations.

A fly screen known as Genius was recently put on the market, which was designed to overcome the aforementioned problems. It is particularly used for horizontal fly screens, with the movement of the rewind roll imposed by manual traction of a closed-loop chain. This type of assembly, used for doors with a large inter-axis, is made up basically of:

- a casing containing a rewind roll which is pre-charged by operating in conjunction with at least one torsion spring;
- a mesh-type screen which is fastened at one end to the rewind roll, and to a handle at the other end;
- runners in which the ends of the handle slide; and
- a handle, the ends of which operate in conjunction with holding means located in the lower part of the runners.

The user, when unwinding the screen, pulls the closed-loop chain in one direction to carry out the lowering of the screen, until its respective handle reaches the limit at the base of the opening in question. When this position has been reached, in order to fasten the handle and, therefore, keep the screen in a stretched position, the user must be able to carry out a further pull-so that the handle, made out of a rectangular tubular profile, rotates and inclines slightly on one side. In this position, pieces that protrude from the two ends of the handle intercept dedicated seats formed on the lower side of the runners, forcing the pieces to take up a certain position. At this point, the user releases the closed-loop chain so that the screen, which is under tension, pulls the handle upwards to force it from a slightly rotated position into a vertical position, forcing the pieces into corresponding recesses with stop points.

In order to release the handle and rewind the screen, the assembly has a type of pedal fastened to the handle. The purpose of this pedal, which is located in a central position, is that when it is pressed by the user, it works in conjunction with the movement applied to the closed-loop chain. In particular, the user has to apply a slight pull downward on the chain with one hand in order to move the screen, while pressing the pedal with a foot. The pressure applied in this way on the pedal obliges the handle to rotate on one side, releasing it from its holding point and, since it is now free, it may be rewound due to the elastic pull.

The drawbacks, mentioned in the solutions above, have been satisfactorily resolved in patent application No. ITTV2000A000030 (Bettio). The patent describes a quick-release hooking and unhooking device for the handle, used particularly for fly screens and fly screen assemblies with a chain type movement made with the system, which comprises:

- a casing containing a rewind roll which is pre-charged by operating in conjunction with at least one torsion spring;
- a mesh-type screen which is fastened at one end to the rewind roll, and to a handle at the other end;
- runners in which the ends of the handle slide; and
- a handle with a tubular profile, with a hooking means on at least one end which operates in conjunction with a reciprocal holding means, located at the lower end of the corresponding runner; in which, the holding means consists of a block, which is fastened to the lower end of the runner. The block is open on one side and has two surfaces that face each other and which have a mirror-image track with an inlet and an outlet, and an intermediate rest position. The track is hooked by a hooking means located at the end of the handle, and includes a guide piece which is joined to the handle and which longitudinally guides a mobile tip. The tip has a protruding pin on at least one of its sides that fits into at least one of the two tracks in the block.

Although this solution is of considerable value because of its contribution in resolving the problems connected with the pre-existing assemblies, it is still not completely optimized. In fact, following a series of laboratory tests, the applicant for the patent has noticed that the functionality of the stop mechanism of the handle is inconsistent, especially in certain conditions. The malfunction has been noticed when the lowering movement of the screen is carried out very quickly, where the path of the tip in the block is intercepted correctly, but it is also immediately released.

This event happens quite frequently, and is due to the fact that it is difficult to dampen the contact of the tip, which is part of the hooking mechanism joined to the ends of the handle, when the tip, or a part of it, strikes against the lower, inclined portion of the first part of the track. In this case the tip, which is the main moving part on the end of the handle, tends to rebound and, instead of slipping into the recess located between the inlet and outlet part of the track, hits above and overrides it, and ends up in a position which, being free of obstacles, is immediately before the outlet.

The result is that the handle is not hooked at the lower end of the runners, and in some cases may be distant from the base. Under these circumstances, apart from the fact that the screen is not pulled tight, there may be a gap through which insects may enter or, in the case of blinds, light may enter.

In view of the above considerations, therefore, it is imperative to single out an acceptable solution.

BRIEF SUMMARY OF THE INVENTION

This and other aims are achieved through the use of this invention according to the characteristics in the attached claims, solving the problems described by means of a fly screen with a quick-release mechanism for hooking and unhooking the handle, used particularly for fly screens and fly screen assemblies with a chain-operated movement, and which includes:

- a casing containing a rewind roll which is pre-charged by operating in conjunction with at least one torsion spring;
- a mesh-type screen which is fastened at one end to the rewind roll, and to a handle at the other end;
- runners in which the ends of the handle slide;
- a handle, in which at least one end has a hooking means and which operates in conjunction with a reciprocal holding means, located at the lower end of the corresponding runner;
- at least one holding means at the lower end of the runner, with the upper part which is open and which contains a guide track with an inlet and an outlet, and an intermediate rest position; and
- at least one hooking means located at the end of the handle, and which includes a guide piece attached to it, which longitudinally guides a mobile tip. The tip has a protruding pin on at least one side that fits into at least one of the two guide-tracks in the holding means; and in which at the beginning of the guide track, formed in the inlet of the holding means in correspondence with the lower part of at least one runner, there is a deviation towards the lower part which works in conjunction with a stop point.

The aim of this invention, therefore, is to overcome the drawback described in the previous solution, where the mechanism is not hooked correctly when the manoeuver for closing the screen is carried out, and once the handle has been pulled all the way down by the user.

In detail, the presence of the deviator formed by the inlet, and which momentarily interrupts the track which is followed by the tip, allows any excess force operated by the user on the handle to be buffered. Also, there is a vertical stop point located below the opening in order to prevent further unwinding of the handle even when it is pulled too sharply, and which also absorbs the residual forces.

The advantage of this detail, therefore, is that the blocking movement of the handle may be carried out safely and easily, to guarantee that it is always temporarily blocked in position.

The advantage, therefore, is that the screen is always held tightly in position.

These and other advantages will be shown in the following detailed description and drawings of at least one preferred application of the system, which is to be considered merely an illustration and not a limitation.

DETAILED DESCRIPTION OF THE INVENTION

Figure 1:
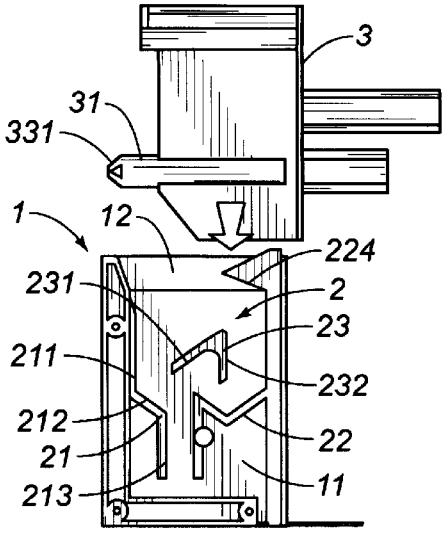
FIG. 1 is a side plan view of the internal part of one of the blocks which is attached to the lower end of the runner, and which helps in guiding the handle. In the upper portion of FIG. 1, there is an illustration of a part of the hooking mechanism which is fastened to the lateral end of the handle. Both parts are shown with the handle in a lowered position, which precedes engagement of the hooking mechanism with the corresponding end portion of the runner.
Figure 2:
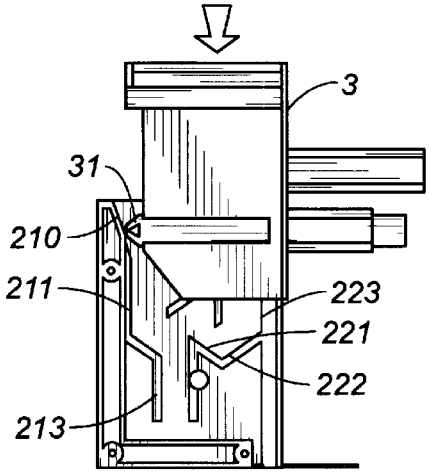
FIG. 2 shows a plan view of the next phase of both the parts which are illustrated in fig. I.
Figure 3:
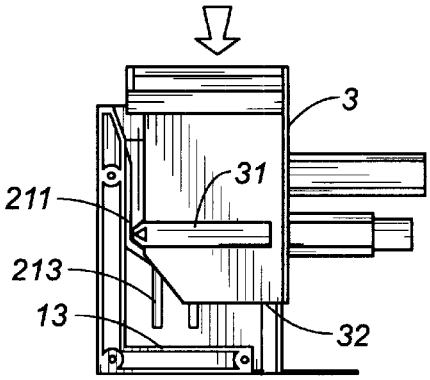
FIG. 3 shows a plan view of the next phase of both the parts illustrated in FIG. 2.
Figure 4:
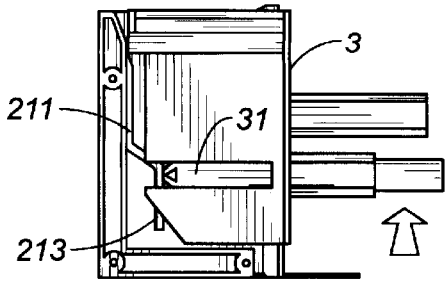
FIG. 4 shows a plan view of the next sequential phase with respect to the previous one, and which corresponds to the lower limit position of the handle.
Figure 5:
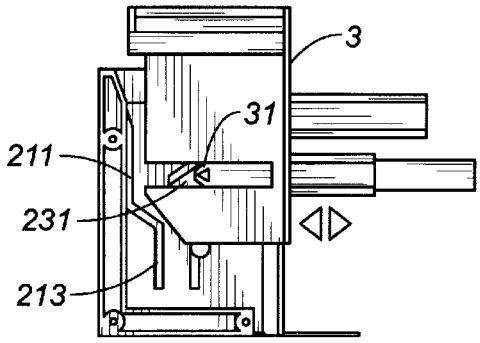
FIG. 5 is a plan view which shows the temporary blocking phase of the handle, in order to keep the screen tight.
Figure 6:
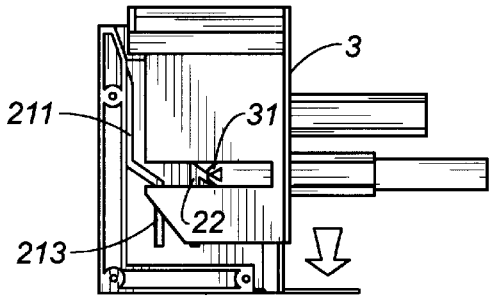
FIG. 6 is a plan view of the next phase with respect to the previous sequences, and in which the unhooking phase of the handle is illustrated.
Figure 7:
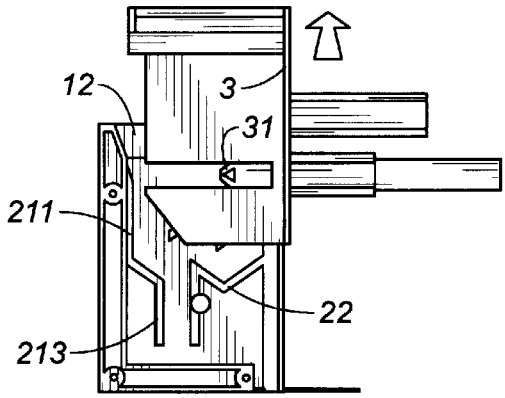
FIG. 7 is a plan view which shows the phase in which the handle goes back up.

With reference to the illustrations, a fly screen with a vertical movement includes at least two runners which act as guides, and which are fastened, one on each side, of the space to be fitted out, and an upper casing for holding the fly screen, roller blind or sun blind, made up of a body in extruded aluminum, for example. Inside the casing, there is a corresponding rewind roll. The rewind roll for the fly screen, roller blind or sun blind, has a rewinding mechanism which includes a torsion spring that, if rotated in one direction, and since it is held in position at one end, is stretched to allow the rewind roll to rotate in the opposite direction to return back to its position. The mechanism also has, on at least one side, a closed-loop chain which moves a rotating component inside the casing, which is fastened to the roll.

Going further into detail, one end of the fly screen, roller blind or sun blind is fixed to the rewind roll, while the opposite end has a handle, which has its ends (3) which slide inside guide runners.

Each guide runner has a block (1) at its lower end made up of a monolithic body in, preferably, low-friction plastic. The block (1), which may also be formed by joining two mirror-image half-blocks for example, has a guide track (2) formed on the inner face (11) of each respective half-block. The track is made by basically forming ribs (21, 22, 23) which are perpendicular with respect to the side in question. Going further into detail, given that the position of the inlet and of the outlet of the track (2) corresponds to an opening along the upper side (12) of the block (1), the track (2) has:

- a first part which is vertical (211);
- a second part which is diagonal (212) and which leads to a deviation (213) which is followed vertically in both directions, and in which the part relative to the return direction has a longer path than with the first one;
- a temporary blocking area for the end (3) of the handle, made from the isolated rib (23) located above the ribs (21, 22);
- a successive part which follows diagonally and downwards (221), followed by another diagonal part (222), but which goes in an upwards direction;
- a vertical part (223) which leads towards the outlet (12); and
- a short, diagonal part (224) up to the point in which the guide track (2) is completely cleared.

The purpose of the track (2) is for the holding and releasing of the end (311) of a pin-type tip (31) or tip which, being longitudinally mobile, interacts with the upwards and downwards movement given by the handle. Going further into detail, inserted into each end of the tubular handle, there is a monolithic guide piece (3) that protrudes, and on one side slides along the inside of the runner. Each guide piece (3) has a transversal seat, which permits the tip (31) to slide on a horizontal axis. In this case, the guide piece (3) has a slit (32) on both sides, along which the end (311) of the tip (31) passes and is free to slide. Going further into detail, the end (311) of the tip (31) has two symmetrical, counter-facing protrusions which are triangular. In this way, the end (311) of the tip (31) follows the relative track (2) formed on the corresponding side (11) of the block (1).

When operating the system, the user pulls down on a chain to lower the fly screen. The chain rotates a rewind roll that is slightly pre-loaded by means of a spring. The rewind roll rotates and lets the fly screen, with its relative weighted handle, lower down due to the force of gravity. The handle is positioned inside the runners by means of the guide pieces (3), so that it intercepts the inside of the runner with its relative tip (31). When the handle gets close to the bottom, it allows the user to feel an obstacle which is given, for example, by the interference between the protruding parts (311) of the tip (31), when not in line, with one of the surfaces of the obstacle formed on the sides of the track (2).

Said surfaces may be formed by the side (231) of the central zone, located immediately below the inlet/outlet (12), or the diagonal part (210) that precedes the straight part (211) that leads towards the lower diagonal part (212). If the protrusions (311) of the tip (31) are in line, on the other hand, they are guided vertically by the rib portion (211) and intercept the lower diagonal part (212). When the obstacle is felt, the user carries out a further, light pull towards the bottom, which determines a further movement of the tip (31) along the guide track (2). In this final phase, which precedes the attachment, the tip (31) is guided towards the vertical part defined by the rib (213) and induced to go further down compared with the level defined by the previous rib (212). It is clear, therefore, that the path of the end piece (3) towards the bottom may not go further than the point which corresponds to the limit of the lower portion (32) against the shoulder (13) formed along the bottom of the inside of the block (1). This corresponds with the lower limit and at this point the user may release the chain. Since the net of the fly screen is forced to return upwards due to the pull of the return spring on the rewind roll, the handle is also forced to return upwards, aided by the position of the ribs (213) between which the end (311) of the tip (31) slides. Going further into detail, the ribs (213) are positioned in such a way that there is a conical shape towards the upper part, which helps lead the end part (311) towards the inclined portion (231) which crosses the gap in the portion (212, 221), so that it may lodge in the seat(s) formed by the counterfacing portion of the rib (232). When the handle (2) is in this position, it stays in a hooked position, with the net of the fly screen pulled perfectly tight.

In order to release the handle, the user has to pull the chain down which causes the handle and, therefore, the guide piece (3) and relative tip (31) to be lowered, until it reaches the lower diagonal part (221). In this position, the tip (31) moves back in order to unhook it from the seat(s) so that, when the chain is slowly released, the handle rises up and the end (311) of the tip (31) is guided along the ribs (222, 223) until it leaves the outlet (12).

We claim:

1. A fly screen apparatus comprising:

a casing containing a rewind roll, said rewind roll being rotatably resiliently mounted in said casing by at least one torsion spring;

a screen having one end fastened to said rewind roll, said screen having a handle at an opposite end thereof, said screen having a sliding axis;

a pair of runners respectively slidably receiving opposite ends of said handle, each of said opposite ends of said handle having a hooking means thereon for moving cooperatively along a holding means on a side of the runner, said holding means having an inlet and an outlet of a guide and positioning track formed on said side of the runner, said holding means having an intermediate rest element formed on said side of the runner, said hooking means having a guide piece supporting a tip, said tip being longitudinally mobile, said tip having a portion that extends outwardly on one side of said guide piece, said guide and positioning track having a deviation oriented longitudinally with said sliding axis, said deviation extending downwardly from a diagonal portion of said guide and positioning track, said deviation positioned between said diagonal portion of said intermediate rest element.

2. The fly screen apparatus of claim 1, said holding means having a limit stop element positioned below said deviation.

3. The fly screen apparatus of claim 1, the guide runner having a block formed of a monolithic body, said guide and positioning track formed on one side of said block, said guide and positioning track having a first part which is vertical and extends downwardly to said diagonal portion, said deviation being vertically oriented with one side connected to said diagonal portion and an opposite side spaced in parallel relation to said one side, said opposite side being longer than said one side, a successive portion extends diagonally and downwardly from an upper end of said opposite side, another diagonal portion extends upwardly from said successive portion, a vertical portion extends from an end of said another diagonal portion so as to lead to said outlet, an inward diagonal part is positioned at an upper end of said vertical portion at said outlet.

4. The fly screen apparatus of claim 1, said guide and positioning track being formed by a series of formed discontinuous ribs extending perpendicularly to said side of said runner.

5. The fly screen apparatus of claim 1, said deviation being formed by two opposed ribs defining a slot therebetween.

* * * * *